United States Patent [19]

Tsukamoto et al.

[11] Patent Number: 4,925,062

[45] Date of Patent: May 15, 1990

[54] PAPER FEEDER

[75] Inventors: Kimihide Tsukamoto, Yamatokoriyama; Masaru Tsuji, Nara, both of Japan

[73] Assignee: Sharp Kabushiki Kaisha, Osaka, Japan

[21] Appl. No.: 263,913

[22] Filed: Oct. 28, 1988

[30] Foreign Application Priority Data

Oct. 30, 1987 [JP] Japan ..... 62-276827
Oct. 30, 1987 [JP] Japan ..... 62-167567

[51] Int. Cl.[5] ..... B65H 3/06

[52] U.S. Cl. ..... 271/115; 271/114; 271/116; 271/117; 271/118; 271/121; 271/267; 271/167

[58] Field of Search ..... 271/114, 115, 116, 117, 271/118, 121, 267, 109, 167

[56] References Cited

U.S. PATENT DOCUMENTS

| | | | |
|---|---|---|---|
| 3,815,900 | 6/1974 | Schulze | 271/118 |
| 4,097,041 | 6/1978 | Fujimoto | 271/118 X |
| 4,319,740 | 3/1982 | Ulseth | 271/118 X |
| 4,717,139 | 1/1988 | Sootome et al. | 271/116 |
| 4,768,771 | 9/1988 | May | 271/167 X |
| 4,798,649 | 1/1989 | Ross | 271/267 X |

FOREIGN PATENT DOCUMENTS

| | | | |
|---|---|---|---|
| 0051521 | 3/1987 | Japan | 271/117 |
| 0041332 | 2/1988 | Japan | 271/121 |

*Primary Examiner*—Kevin P. Shaver
*Assistant Examiner*—Boris Milef

[57] ABSTRACT

A paper feeder system inclusive of a paper feed table for placing paper thereon, a transport roller, a first shaft for supporting the transport roller thereon, feed rollers, a first arm pivotably supported by the first shaft and extending toward the feed table, a delivery roller mounted on the first arm for delivering the paper from the feed table to the transport roller. A second arm pivotably supported between the delivery roller and the transport roller, and a shutter is attached to the second arm for preventing delivery of the paper to the transport roller. A first cam and a first cam shift therefor are provided for pivotally moving the first arm to thereby shift the delivery roller to an operative position, and a second cam and a second cam shaft therefor for pivotally moving the second arm to thereby shift the shutter to an operative position when the first arm is not pivotally moved, the first cam shaft and the second cam shaft being combined together in the form of a single rotary shaft.

7 Claims, 7 Drawing Sheets

PAPER FEEDER

BACKGROUND OF THE INVENTION

1. Field of the Invention

The present invention relates to paper feeders, and more particularly to a paper feeder, for example, for use in an image forming apparatus, such as electrostatic transfer copying machines, laser printers and facsimile systems, electronic typewriters, word processors, ADFs for copying machines, and the like.

2. Description of the Prior Art

Conventional copying machines include a paper feed table for placing paper thereon, a transport roller for transporting the paper from the table toward feed rollers, a first arm pivotably supported by the shaft of the transport roller and extending toward the feed table, a delivery roller mounted on the forward end of the arm, a separating roller adapted for contact with the transport roller for preventing feed of more than one sheet of paper at a time, a second arm pivotably supported between the transport roller and the delivery roller, and a shutter attached to the second arm for blocking the paper.

The delivery roller and the shutter are controlled at the same time with a solenoid (see, for example, U.S. Pat. No. 4,089,516) or individually by respective cams each at a proper time.

However, the former method requires a great solenoid for pivotally moving the delivery roller which is heavy and therefore involves the problem that the solenoid makes the machine large-sized.

The latter method requires a drive mechanism for each of the cams, similarly making the apparatus large-sized and necessitating an increased number of parts.

SUMMARY OF THE INVENTION

The present invention provides a paper feeder comprising a paper feed table for placing paper thereon, a transport roller for transporting the paper, a first shaft supporting the transport roller thereon, feed rollers for forwarding the paper transported by the transport roller, a first arm pivotably supported by the first shaft and extending toward the feed table, a delivery roller mounted on the first arm for delivering the paper from the feed table to the transport roller, a second arm pivotably supported between the delivery roller and the transport roller, a shutter attached to the second arm for preventing delivery of the paper to the transport roller, a first cam and a first cam shaft therefor for pivotally moving the first arm to thereby shift the delivery roller to an operative position, and a second cam and a second cam shaft therefor for pivotally moving the second arm to thereby shift the shutter to an operative position when the first arm is not pivotally moved, the first cam shaft and the second cam shaft being combined together in the form of a single rotary shaft.

According to the present invention, the first cam shaft for pivotally moving the first arm to thereby shift the delivery roller to an operative position comprises the same shaft as the second cam shaft for pivotally moving the second arm to thereby shift the shutter to an operative position. This is one of the important features of the present feeder, serving to make the feeder smaller in size and rendering the delivery roller and the shutter pivotally movable with proper timing with good stability. Consequently, the feeder is operable with good stability at all times free of error, for example, for use in high-speed copying machines.

The paper feeder of the present invention further includes a first solenoid and a second solenoid which can be provided as a single solenoid, whereby the feeder can be further compacted greatly.

Further, according to the present invention, the feed table is removably attached to the body of an apparatus, such as an image forming apparatus, for which the feeder is used, and the transport roller is provided with a separating roller, a support member for supporting the separating roller upwardly and downwardly movable, pressure means for pressing the support member to bring the separating roller into pressing contact with the transport roller, and release means for bringing the pressure means out of operation with the removal of the feed table. The paper, as nipped between the transport roller and the separating roller, is easily removable by virtue of this arrangement. Thus, the feeder is made operable with improved stability.

BRIEF DESCRIPTION OF THE DRAWINGS

FIG. 2(*b*) is a sectional view of a spring clutch;

FIG. 3(*a*) is a plan view showing the relationship when a solenoid is unenergized;

FIG. 3(*b*) is a front view of the same;

FIG. 3(*c*) is the same front view of FIG. 3(*b*) including the solenoids;

FIG. 4(*b*) is a front view of the same;

FIG. 5(*b*) is a front view of the same.

FIG. 6 is a diagram showing the relationship between the first cam and the shutter in a standby position;

FIG. 7 is a diagram showing the relationship between the second cam and the delivery roller in a standby position;

FIG. 8 is a diagram showing the relationship between the second cam and the shutter as positioned for the delivery of paper;

FIG. 9 is a diagram showing the relationship between the first cam and the delivery roller as positioned for the delivery of the paper;

FIG. 10 is a diagram showing the relationship between the second cam and the shutter after the clutch cover has rotated almost by one turn;

FIG. 11 is a diagram showing the relationship between the first cam and the delivery roller after the clutch cover has rotated almost by one turn;

DETAILED DESCRIPTION OF THE INVENTION

Figure 1:
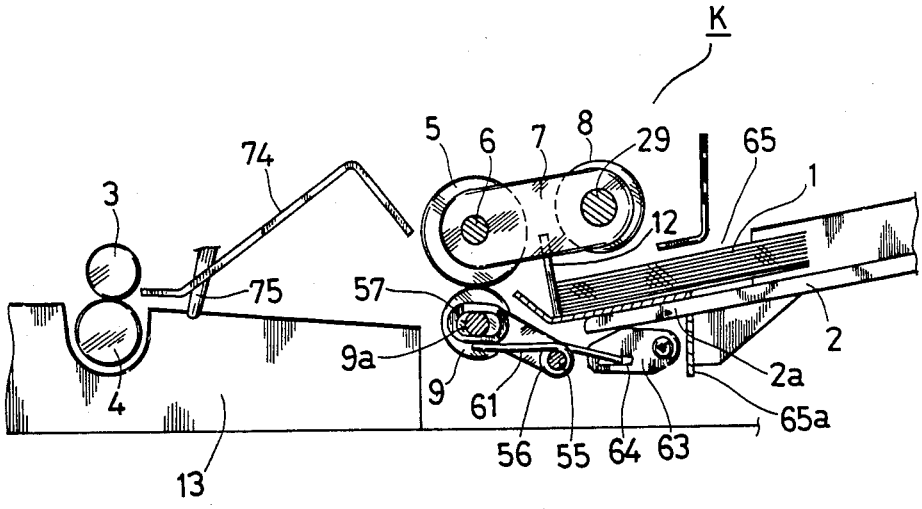
FIG. 1 is a front view showing a paper feeder embodying the present invention as it is used for a copying machine.
Figure 3C:
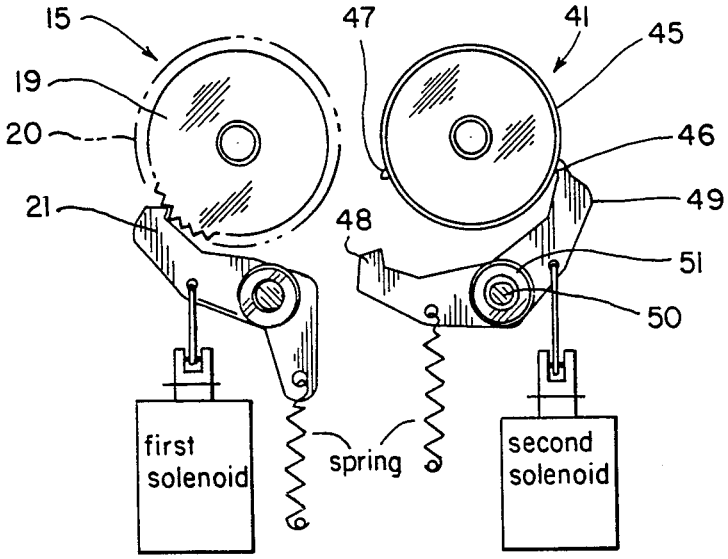
FIGS. 3(*a*) and (*b*) to FIGS. 5(*a*) and (*b*) are views showing the relationship between spring clutches and pawls.
Figure 2A:
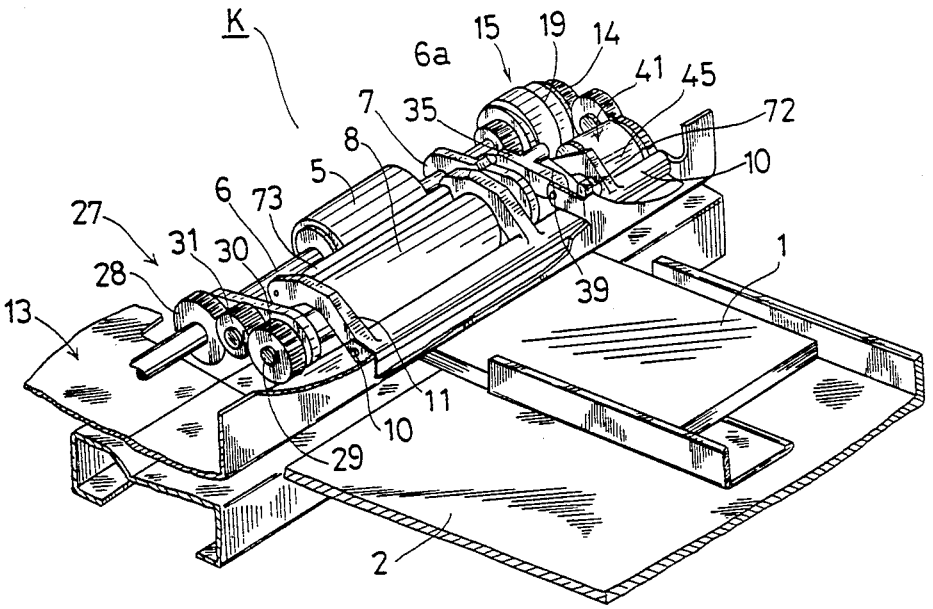
FIG. 2(*a*) is a perspective view of the same.
Figure 2B:
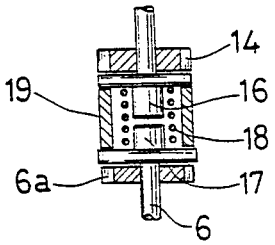
Figure 3A:
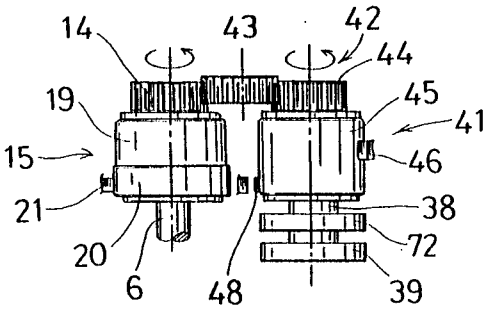
Figure 3B:
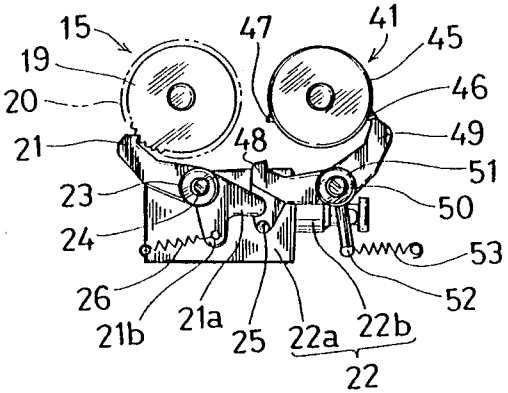

First, a paper feeder K for use in a copying machine will be described generally to clarify the features thereof. With reference to FIGS. 1 and 2, the paper feeder K comprises a paper feed table 2 for placing paper 1 thereon, a transport roller 5 for transporting the paper 1 toward feed rollers 3, 4, a first shaft 6 supporting the roller 5 thereon, a first arm 7 pivotally supported by the first shaft 6 and extending toward the feed table 2, a delivery roller 8 mounted on the forward end of the first arm 7, a second arm 11 supported by a second shaft 10 and disposed between the transport roller 5 and the delivery roller 8, a shutter 12 attached to the second arm 11 for blocking the paper 1, a first cam 39 for pivotally moving the delivery roller 8 about the first shaft 6, and a second cam 72 for pivotally moving the shutter 12 about the second shaft 10. As seen in FIG. 3(*a*), the feeder is first characterized in that the first cam 39 and the second cam 72 are commonly mounted on the drive shaft 38 of a clutch 41 for controlling the rotation of the two cams 39, 72.

The feeder is further characterized in that a single solenoid 22 controls a clutch 15 for controlling the rotation of the transport roller 5 and the clutch 41 for controlling the rotation of the cams 39, 72. FIG. 3(*c*) illustrates the utilization of separate first and second solenoids for the control of clutches 15 and 41.

When the paper 1 is to be fed, the delivery roller 8, which is usually in a raised position as seen in FIG. 1, temporarily falls onto the paper 1 under gravity after the shutter 12 is raised, delivering the paper 1 to the transport roller 5. The paper 1 is then transported by the roller 5 to the feed rollers 3, 4 which are at a stop. The feed rollers 3, 4 start to transport the paper 1 in synchronism with a document scanning table, with the leading end of the paper in coincidence with the leading end of the document image.

Figure 6:
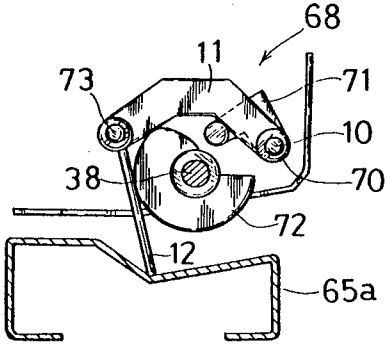
FIGS. 6 to 11 are diagrams showing the relationship of two cams with a delivery roller and with a shutter.
Figure 7:
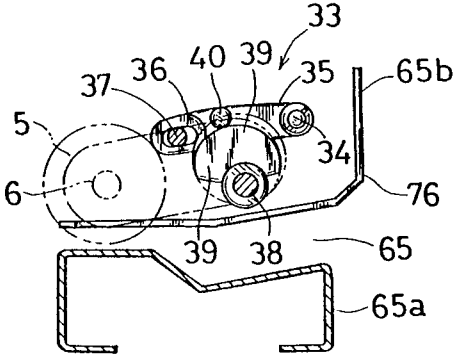

FIG. 3(*b*) shows the solenoid 22 as unenergized. A clutch cover 19 of the clutch 15 andd a clutch cover 45 of the clutch 41 are restrained from rotation by a first pawl piece 21 and a third pawl piece 49, respectively, so that the transport roller 5 and the cams 39, 72 are at rest, with no drive power transmitted thereto. Thus, the parts are in a standby position as seen in FIGS. 6 and 7.

Figure 4A:
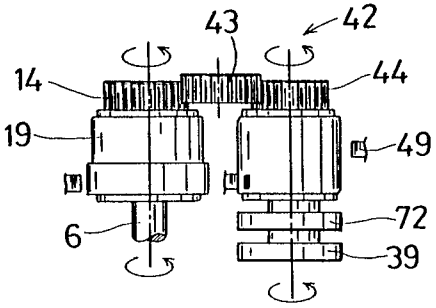
FIG. 4(*a*) is a plan view showing the relationship when the solenoid is energized.
Figure 4B:
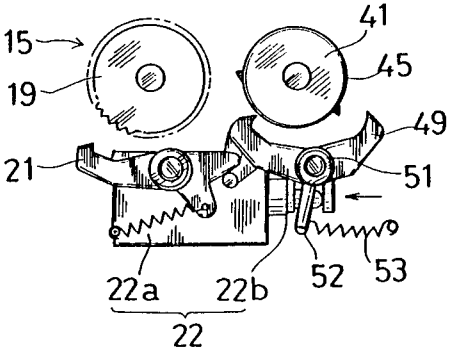
Figure 8:
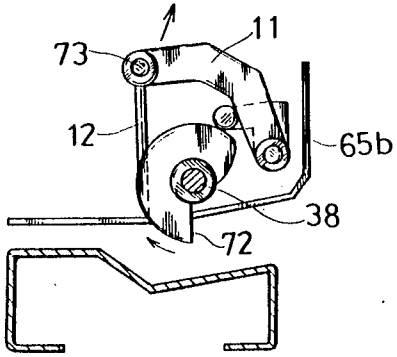
Figure 9:
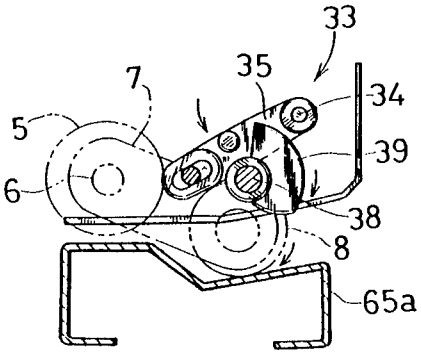

When the solenoid 22 is energized, the first pawl piece 21 releases the clutch cover 19 to drive the first shaft 6, which in turn starts rotating the transport roller 5. The rotation of the first shaft 6 also starts rotating the delivery roller 8 through gears 28, 31 and 30. Further since the clutch cover 45 is also released from the third pawl piece 49 to rotate the cams 39, 72 as seen in FIG. 4, the shutter 12 and the delivery roller 8 start to move as shown in FIGS. 8 and 9 (delivery and transport of the paper).

Figure 5A:
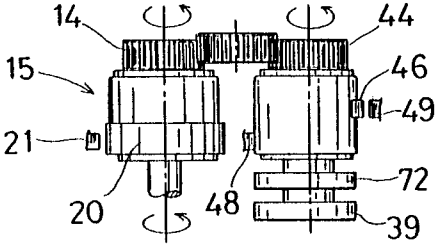
FIG. 5(*a*) is a plan view showing the relationship when a clutch cover of the spring clutch has rotated almost by one turn upon the energization of the solenoid.
Figure 5B:
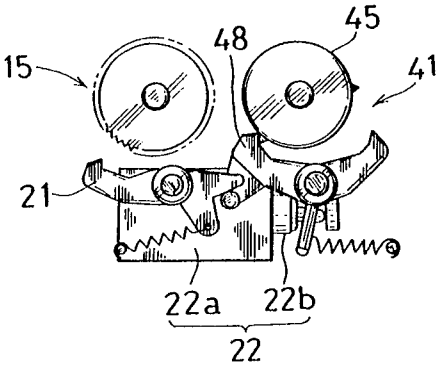
Figure 10:
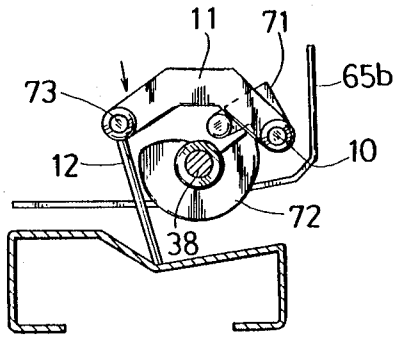
Figure 11:
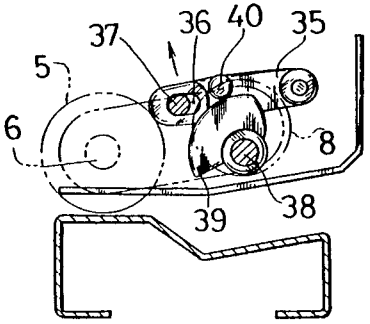

The clutch 41 has right and left claws 46, 47 which are displaced from each other axially thereof, and a second pawl piece 48 and the third pawl piece 49 are similarly displaced from each other, with the result that when the clutch cover 45 has almost completed one turn of rotation after the energization of the solenoid 22, the second pawl piece 48 engages the claw 47 as seen in FIG. 5(*b*). Consequently, with the solenoid 22 in energized state, the clutch 15 remains engaged to hold the transport roller 5 in rotation, whereas the clutch 41 is disengaged upon the clutch cover rotating almost one turn to stop the cams 39, 72. By this time, the delivery roller 8 is in its raised position as seen in FIG. 11, while the shutter 12 is in its lowered position as shown in FIG. 10 (transport of the paper).

The solenoid 22 is deenergized a specified period of time after a sensor switch 75 detects the paper to warp the paper.

Upon the deenergization of the solenoid 22, the first pawl piece 21 engages the clutch cover 19 of the clutch 41 to stop the transport roller 5. The clutch 41 stops upon returning to the initial position (FIG. 3) after completing one turn of rotation, whereby the paper feed operation is completed (warping the paper, standby state).

As will be apparent from the above description, the first and second cams for pivotally moving the delivery roller and the shutter are commonly mounted on the same shaft as the clutch for controlling these cams, so that the paper feeder K can be small-sized. With the two cams mounted on the same shaft, the delivery roller and the shutter are pivotally movable with proper timing with good stability. This assures a stabilized paper feed operation at all times free of errors for a high-speed copying operation.

The paper feeder has another advantage in that it can be produced in a smaller size at a lower cost because a single compact solenoid is used for controlling the clutch for controlling the rotation of the transport roller and the clutch for controlling the rotation of the cams.

Figure 12:
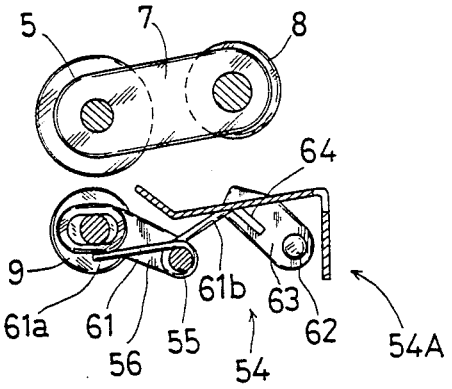
FIG. 12 is a front view showing pressure means for a separating roller.
Figure 13:
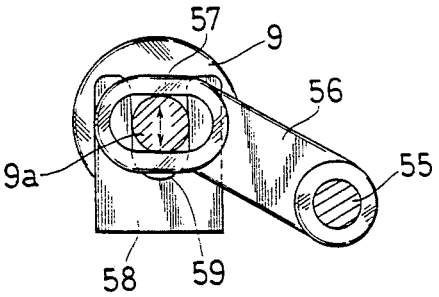
FIG. 13 is a fragmentary enlarged view of the same.

The paper feeder K for the copying machine further comprises a separating roller 9 adapted to contact the transport roller 5 for preventing feed of more than one sheet of paper at a time (double feed), and support-pressure means 54 for supporting the separating roller 9 and pressing the roller 9 against the transport roller 5 as seen in FIGS. 1 and 12. The paper feed table 2 is removably attached to the body 13 of the copying machine. The feeder further comprises release means 54A for releasing the separating roller 9 from pressing contact with the transport roller 5 when the table 2 is removed from the machine body 13.

The separating roller 9 is mounted on the forward end of a pressure lever 56 movable about a pivot 55 on the machine body 13. The pressure lever 56 is provided at its forward end with a guide ring 57 for laterally guiding the shaft 9*a* of the separating roller 9. The roller shaft 9*a* is fitted in the ring 57 and is also fitted in a vertical groove 59 in a support plate 58 on the body 13 vertically movably.

The paper 1 to be fed is transported by the transport roller 5 to the feed rollers 3, 4, which in turn start to further transport the paper 1 in synchronism with the document scanning table, with the leading end of the paper in coincidence with the leading end of the document image.

The paper feed table 2 for stacking sheets of paper thereon is removable when to be carried. The release means 54A has a pivotal piece 63, which is moved upward by a spring 61 when the table 2 is removed as seen in FIG. 12, releasing the separating roller 9 from pressing contact with the transport roller 5. The paper 1 as nipped between the rollers 5, 9 is then easily removable.

While the pressure lever 56 exerts pressure on the shaft 9*a* of the separating roller 9, the guide ring 57 of the lever 56 has a laterally elongated hole for retaining the roller shaft 9*a* therein. The shaft 9*a* is laterally restrained by the vertically grooved portion 59 of the separate guide plate 58, so that the roller 9 is pressed on at all times from immediately below the transport roller 5.

Figure 16:
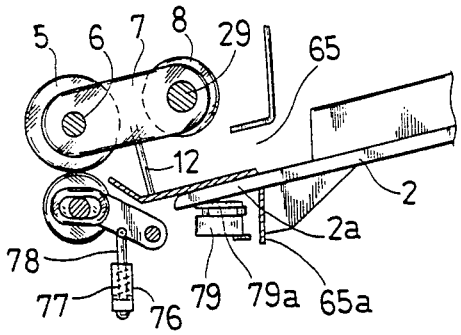
FIG. 16 is a front view showing another embodiment of the invention.

The pressure means and the release means therefor need not always be so constructed as described above but may have the construction shown in FIG. 16. A solenoid 76 has a plunger 78 connected to the pressure lever 56 and biased by a spring 77 toward the transport roller 5. A microswitch 79 is disposed under a lower guide plate 65*a* defining a path of feed of the paper, 65. A plate spring 79*a* for actuating the switch 79 when the feed table 2 is removed is disposed in the vicinity of the switch 79.

When the feed table 2 is removed with this arrangement, the plate spring 79*a* moves upward to turn on the switch 79, causing the solenoid 76 to withdraw the plunger 78 and moving the separating roller 9 away from the transport roller 5.

The body of the copying machine may be provided with a handle for use in transporting the machine.

With the paper feeder K described above, the separating roller is released from pressing contact with the transport roller by the release means when the paper feed table is removed, so that the paper nipped between the rollers can be readily removed merely by the simple procedure of removing the paper feed table.

Further because the guide ring of the pressure lever has a laterally elongated hole for retaining the separating roller shaft, which is restrained by the vertically grooved portion of the guide plate, pressure is applied to the separating roller from immediately below the transport roller at all times. This assures the advantage that the paper can be fed with good stability.

Figure 17:
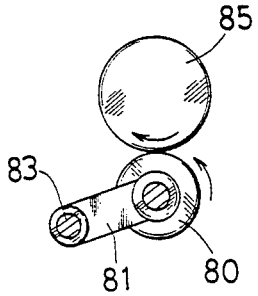
FIG. 17 is a front view showing conventional pressure means.
Figure 18:
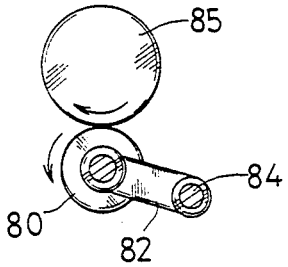
FIG. 18 is a front view showing another conventional pressure means.

FIGS. 17 and 18 show conventional pressure means, in which a separating roller 80 is supported directly by a pressure lever 81 or 82. Depending on the position 83 or 84 when the lever 81 or 82 is supported and on the direction of rotation of a transport, the pressure to be applied decreases or increases, so that it is difficult to obtain a definite pressure at all times.

Further when the level at which the rollers 80 and 85 are in contact with each other varies, the position of contact also varies laterally and is not always definite. Consequently, the paper inserted manually can not be fed with good stability.

The paper feeder K for the copying machine will be described in its entirety in greater detail.

With reference to FIGS. 1 and 2, the paper feeder K comprises a paper feed table 2 for placing paper 1 thereon, a transport roller 5 for transporting the paper 1 toward feed rollers 3, 4, a first shaft 6 supporting the roller 5 thereon, a first arm 7 pivotally supported by the first shaft 6 and extending toward the feed table 2, a delivery roller 8 mounted on the forward end of the first arm 7, a separating roller 9 adapted to contact the transport roller 5 for preventing double feed, a second arm 11 supported by a second shaft 10 and disposed between the transport roller 5 and the delivery roller 8, and a shutter 12 attached to the second arm 11 for blocking the paper 1. The second shaft 10 is rotatably supported by the body 13 of the copying machine.

The transport roller 5 has its center shaft, i.e. the first shaft 6, rotatably supported on the body 13. A drive gear 14 for drivingly rotating the first shaft 6 is connected to the shaft 6 by a first spring clutch 15. Power is transmitted to the drive gear 14 from the machine body 13. The first spring clutch 15 comprises, as seen in FIG. 2(*b*), a coiled spring 18 wound around a boss 16 formed on one shaft end of the drive gear 14 and around a boss 17 formed on one end of the first shaft 6, a hollow cylindrical clutch cover 19 fitted around the coiled spring 18, a hollow cylindrical latch 20 fixedly provided around the clutch cover 19 as shown in FIGS. 3(*a*) and (*b*), a first pawl piece 21 engageable with the latch 20, and a solenoid 22 serving as drive means for bringing the first pawl piece 21 into or out of engagement with the latch 20. The spring 18 has one end engaged with the clutch cover 19 and the other end secured to the boss 17 of the first shaft 6. The spring 18 is wound in a direction to fasten together the boss 16 of the drive gear 14 and the boss 17 of the first shaft 6. When the clutch cover 19 is restrained from rotation, the spring 18 is loosened from the boss 16 so as not to transmit the torque of the drive gear 14 to the first shaft 6.

With reference to FIG. 3(*b*), the first pawl piece 21 is rotatably supported at a central boss portion thereof by a pivot 24 on the body 22*a* of the solenoid and has one end 21*a* in engagement with a pin 25 on the second pawl piece 48 to be described later. The first pawl piece 21 is so associated with the second pawl piece 48 as to be moved away from the latch 20 by the rotation of the piece 48 in an engaging direction. A spring 26 is connected between another end 21*b* of the first pawl piece 21 and the body 22*a* of the solenoid for biasing the first pawl piece 21 into engagement with the latch 20.

With reference to FIG. 2(*a*), drive means 27 for drivingly rotating the delivery roller 8 comprises a first gear 28 fixedly mounted on the other end of the frist shaft 6 of the transport roller 5, a second gear 30 fixed to the rotary shaft 29 of the delivery roller 8 and opposed to the first gear 28, and an intermediate gear 31 provided between the first and second gears 28, 30 and supported by the first arm 7.

As shown in FIGS. 2(*a*), 7, 9 and 11, a mechanism 33 for pivotally moving the first arm 7 of the delivery roller 8 comprises a pivotal arm 35 movably supported on a pivot 34 parallel to the shaft 29 of the delivery roller 8 and provided on the machine body 13, a link pin 37 extending from the midportion of the first arm 7 and fitted in a slot 36 formed in the free end of the arm 35, a first cam 39 secured to a driven shaft 38 parallel to the first shaft 6 of the transport roller 5 for moving the pivotal arm 35, a driven member 40 secured to the pivotal arm 35 so as to contact the cam face of the first cam 39, and drive means 42 for transmitting power from the machine body 13 to the driven shaft 38 through a second spring clutch 41 as seen in FIG. 3(*a*). The drive means 42 comprises a transmission gear 43 meshing with the drive gear 14, and a driven gear 44 in mesh with the gear 43.

With reference to FIGS. 3 and 4, the second spring clutch 41 is interposed between the shaft of the drive gear 44 and the driven shaft 38. Like the first spring clutch 15, the clutch 41 comprises a coiled spring, a clutch cover 45, etc. However, the clutch cover 45 is provided on its outer periphery with a pair of clutch claaws 46 and 47 which are displaced from each other axially thereof. The second pawl piece 48 which is at the left and a third pawl piece 49 at the right are engageable with the clutch claws 47 and 46, respectively (see FIG. 3(*b*)).

With reference to FIG. 3(*b*), the second and third pawl pieces 48, 49 extend away from each other as secured to a boss portion 51 which is rotatably fitted around a pivot 50 on the machine body 13. A pivotal piece 52 secured to the boss portion 51 is connected to the plunger **22*b* of the solenoid 22. A spring 53 is connected between the pivotal piece 52 and the machine body 13 for biasing the second pawl piece 48 away from the clutch claw 47**.

Figure 15:
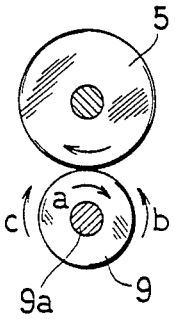
FIG. 15 is a front view showing the directions of rotation of the separating roller.

With refeence to FIGS. 12 and 15, the separating roller 9 is pressed against the transport roller 5 by support-pressure means 54 having the following construction. The separating roller 9 is mounted on the forward end of a pressure lever 56 movably supported by a pivot 55 on the machine body 13. The pressure lever 56 is formed at its forward end with a guide ring 57 for guiding the shaft **9*a* of the separating roller 9 in a lateral direction. The shaft 9*a* is fitted in the ring 57. The roller shaft 9*a* is further fitted from above in a vertical groove 59 formed in a support plate 58 on the machine body 13. The separating roller 9 is biased toward the transport roller 5 by a coiled spring 61. The spring 61 has a coiled portion fitted around the pivot 55 for the pressure lever 56, one end 61*a* bearing against the underside of the guide ring 57, and the other end 61*b* engaged in a slot 64 in a pivotal piece 63 movably supported by a pivot 62 on the machine body 13**.

With reference to FIGS. 1 and 12, the separating roller 9 is freed from the force of the spring 61 by release means 54A, which comprises the above-mentioned pivotal piece 63. The pivotal piece 63 is disposed under a lower guide plate **65*a* defining a path of feed of the paper in the machine body 13. The feed table 2 has at its forward end an extension plate 2*a* which is removably positioned between the pivotal piece 63 and the lower guide plate 65*a*. When the feed table 2 is removed, the pivotal piece 63 moves upward, freeing the separating roller 9 from the force of the spring 61 and permitting the roller 9 to move away from the transport roller 5** under gravity.

Figure 14:
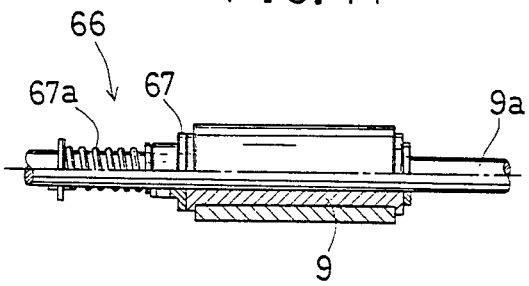
FIG. 14 is a side elevation, partly broken away, and showing means for reversing the rotation of the separating roller.

The separating roller 9 is usually driven by the transport roller 5, but when at least two sheets of paper are delivered thereto, the roller 9 reversely rotates to preclude double feeding. FIG. 14 shows reversing means 66 therefor. The means 66 for reversely rotating the separating roller 9 comprises a brake plate 67 fitted around the shaft **9*a* of the roller 9 slidably axially thereof and rotatable with the shaft, and a coiled spring 67*a* for biasing the brake plate 67 into pressing contact with the separating roller 9. Owing to the frictional resistance between the roller 9 and the brake plate 67, the roller 9 is not rotatable relative to the shaft 9*a* unless subjected to a torque exceeding a specified value. The roller shaft 9*a* usually rotates in the same direction (arrow a shown) as the transport roller 5 as seen in FIG. 15, but when no paper is transported or when only one sheet of paper is transported, the frictional resistance between the transport roller 5 and the separating roller 9 or between the paper and the separating roller 9 is greater than the frictional resistance between the roller 9 and the brake plate 67, so that the separating roller 9 rotates in a direction (arrow b shown) opposite to the direction of rotation of the shaft 9*a*, the roller 9 thus being rotated by the transport roller 5. Alternatively when at least two sheets of paper are delivered to the transport roller at the same time, the frictional resistance between the separating roller 9 and the brake plate 67 is greater than that between the sheets, causing the separating roller 9 to rotate in the same direction (arrow c shown) as the shaft 9*a*** to preclude double feed.

As seen in FIG. 2(*a*), torque is delivered to the roller shaft **9*a* from a gear 6*a* fixed to the first shaft 6 of the transport roller 5**.

With reference to FIGS. 2 and 6, means 68 for pivotally moving the shutter 12 comprises the second shaft 10 supported on the machine body 13 for pivotally moving the shutter, the second arm 11 mounted on the second shaft 10, an L-shaped driven member 71 secured to the boss portion 70 of the second arm 11, a second cam 72 mounted on the same shaft as the first cam 39 (see FIG. 7) for the driven member 71 to follow its cam surface, etc. The shutter 12 is attached to the forward end of the second arm 11 by a pin 73.

The cams 39 and 72 are so shaped and positioned as will be described with reference to FIGS. 6 to 11. First, the shutter 12 is completely moved up to a raised position by the second cam 72, whereupon the first cam 39 causes the arm 35 to move down the delivery roller 8. Before the spring clutch 41 (see FIG. 3(*a*)) makes one turn of rotation, the first cam 39 conversely lifts the delivery roller 8 completely to a raised position. The shutter 12 is thereafter lowered. The cams 39 and 72 are so shaped and timed as to effect the above movements. The period of time during which the delivery roller 8 is in its lowered position is so determined that the delivery roller 8 can satisfactorily deliver the paper to the transport roller 5. Since the cams 39 and 72 are mounted on the same shaft, the shutter and the delivery roller are controlled with proper timing without any error. This assures stabilized operation of the present feeder at all times even when it is used for a high-speed copying machine.

A generally L-shaped upper guide plate 74 is provided between the transport roller 5 and the feed rollers 3, 4 for permitting warping of the paper. In proximity to these rollers 3, 4, a paper sensor switch 75 is provided at the forward end of the upper guide plate 74.

Indicated at **65*b* is an upper guide plate defining the paper feed path 65**.

The operation of the feeder will be described next. The delivery roller 8, which is usually in its raised position as seen in FIG. 1, temporarily falls onto paper 1 under gravity after the shutter 12 is raised, delivering the paper 1 to the transport roller 5. The paper 1 is then transported by the roller 5 and the separating roller 9 to the feed rollers 3, 4 which are at rest.

The paper 1 transported by the roller 5 is detected by the sensor switch 75. A specified period of time after the detection, the transport roller 5 is stopped to warp the paper at the portion thereof positioned between the transport roller 5 and the feed rollers 3, 4. This prevents the leading edge of the paper 1 from skewing with respect to the widthwise direction of the feed path. The feed rollers 3, 4 start to transport the paper 1 in synchronism with the document scanning table, with the leading end of the paper in coincidence with the leading end of the document image.

FIG. 3(*b*) shows the solenoid 22 as unenergized. The clutch cover 19 and the clutch cover 45 are restrained from rotation by the first pawl piece 21 and the third pawl piece 49, respectively, so that the transport roller 5 and the cams 39, 72 are at rest, with no drive power transmitted thereto. Thus, the parts are in the standby position of FIGS. 6 and 7.

With reference to FIG. 4(*b*), when the solenoid 22 is energized, the first pawl piece 21 releases the clutch cover 19 to drive the first shaft 6, which in turn starts rotating the transport roller 5. The rotation of the first shaft 6 also starts rotating the delivery roller 8 through the gears 28, 31 and 30 as seen in FIG. 2(*a*). Further since the clutch cover 45 is also released from the third pawl piece 49 to rotate the cams 39, 72 as seen in FIGS. 4(*a*) and (*b*), the shutter 12 and the delivery roller 8 start to move as shown in FIGS. 8 and 9 (delivery and transport of the paper).

With reference to FIGS. 3(*a*) and (*b*), the right and left claws of the second spring clutch 41 are displaced from each other axially thereof, and the second pawl piece 48 and the third pawl piece 49 are similarly displaced from each other, with the result that when the clutch cover 45 has almost completed one turn of rotation after the energization of the solenoid 22, the second pawl piece 48 engages the claw 47 as seen in FIG. 5(*b*). Consequently, with the solenoid 22 in energized state, the clutch 15 remains engaged to hold the transport roller 5 in rotation, whereas the clutch 41 is disengaged upon the clutch cover rotating almost one turn to stop the cams 39, 72. By this time, the delivery roller 8 is in its raised position as shown in FIG. 11, while the shutter 12 is in its lowered position as shown in FIG. 10 (transport of the paper).

The solenoid 22 is deenergized the specified period of time after the sensor switch 75 detects the paper to warp the paper.

Upon the deenergization of the solenoid 22, the first pawl piece 21 engages the clutch cover 19 of the spring clutch 41 to stop the transport roller 5. The clutch stops upon returning to the initial position (FIG. 3) after completing the rest of the one turn of rotation, whereby the paper feed operation is completed (warping the paper, standby state).

The paper feed table 2 for stacking up sheets of paper thereon is removable when to be carried. When the table 2 is removed as seen in FIG. 12, the separating roller 9 is freed from the force of the spring 61 and moved out of pressing contact with the transport roller 5. The paper 1 as nipped between the rollers 5, 9 is then readily removable.

While the pressure lever 56 exerts pressure on the shaft 9*a* of the separating roller 9, the guide ring 57 of the lever 56 has a laterally elongated hole for retaining the roller shaft 9*a* therein. The shaft 9*a* is laterally restrained by the vertically grooved portion 59 of the separate guide plate 58, so that the roller 9 is pressed on at all times from immediately below the transport roller 5.

The present invention is not limited to the foregoing embodiments. These embodiments can, of course, be modified or altered within the scope of the invention.

For example, the clutches are not limited to spring clutches but can be friction clutches, meshing clutches or the like.

What is claimed is:

1. A paper feeder comprising a paper feed table for placing paper thereon, a transport roller for transporting said paper, a first shaft supporting said transport roller thereon, feed rollers for forwarding said paper transported by said transport roller, a first arm pivotably supported by said first shaft and extending toward said paper feed table, a delivery roller mounted on said first arm for delivering said paper from said feed table to said transport roller, a second arm pivotably supported on a second shaft juxtapositioned to said delivery roller, a shutter attached to said second arm positioned between said delivery roller and said transport roller for preventing delivery of said paper to said transport roller, a first cam and a first cam shaft therefor for pivotally moving said first arm to thereby shift said delivery roller to an operative position, and a second cam and a second cam shaft therefor for pivotally moving said second arm to thereby shift said shutter to an operative position when said first arm is not pivotally moved, said first cam shaft and said second cam shaft being combined together in the form of a single rotary shaft.

2. A paper feeder as defined in claim 1, wherein said rotary shaft comprises a torque transmission shaft, a driven shaft having said first and second cams mounted thereon, and a first clutch provided between said shafts.

3. A paper feeder as defined in claim 2, wherein said first shaft comprises a torque transmission shaft, a driven shaft having said transport roller mounted thereon, and a second clutch provided between said shafts.

4. A paper feeder as defined in claim 3, wherein said first and second clutches respectively comprise first and second clutch portions, first and second pawl pieces and first and second solenoids to operate the respective clutch portions for a clutch action.

5. A paper feeder as defined in claim 4, wherein a single solenoid is provided for moving said pawl pieces to operate said respective clutch portions for a clutch action.

6. A paper feeder as defined in claim 1, wherein said feed table is removably attached to a body of an apparatus for use with said feeder, and said transport roller is provided with a separating roller, a support member for supporting said separating roller movable upwardly and downwardly, pressure means for pressing said support member to bring said separating roller into pressing contact with said transport roller, and release means for bringing said pressure means out of operation with the removal of said feed table.

7. A paper feeder as defined in claim 6, wherein said support member comprises a vertically grooved support plate for supporting a separating roller carrying shaft on said apparatus body movable upwardly and downwardly, said release means comprises a pivotal piece supported by said apparatus body and pivotally movable when said feed table is attached to or removed from said apparatus body, said pressure means comprises a guide ring for guiding said roller shaft substantially laterally, a lever having said guide ring secured thereto and movably supported by a pivot on said apparatus body, and a coiled spring wound around said lever supporting pivot and having one end engaged with said lever and a second end engaged with said pivotal piece for pivotally moving said lever by the movement of said pivotal piece when said feed table is removed from said apparatus body to release said separating roller from pressing contact with said transportation roller.

* * * * *